US012037709B2

(12) United States Patent
Sun et al.

(10) Patent No.: US 12,037,709 B2
(45) Date of Patent: Jul. 16, 2024

(54) DRYING APPARATUS AND DRYING METHOD FOR RAW SILK DEGUMMING PROCESS

(71) Applicant: SOOCHOW UNIVERSITY, Suzhou (CN)

(72) Inventors: Yuchai Sun, Suzhou (CN); Zhonghao Cheng, Suzhou (CN)

(73) Assignee: SOOCHOW UNIVERSITY, Suzhou (CN)

( * ) Notice: Subject to any disclaimer, the term of this patent is extended or adjusted under 35 U.S.C. 154(b) by 692 days.

(21) Appl. No.: 17/276,189

(22) PCT Filed: Sep. 16, 2020

(86) PCT No.: PCT/CN2020/115597
§ 371 (c)(1),
(2) Date: Mar. 15, 2021

(87) PCT Pub. No.: WO2021/068717
PCT Pub. Date: Apr. 15, 2021

(65) Prior Publication Data

US 2021/0388530 A1 Dec. 16, 2021

(30) Foreign Application Priority Data

Oct. 8, 2019 (CN) ..... 201910950058.5

(51) Int. Cl.
*D01C 3/02* (2006.01)
*D06B 15/09* (2006.01)

(52) U.S. Cl.
CPC ..... *D01C 3/02* (2013.01); *D06B 15/09* (2013.01)

(58) Field of Classification Search
CPC ..... D01C 3/02; D06B 15/09
(Continued)

(56) References Cited

U.S. PATENT DOCUMENTS 1,437,491 A * 12/1922 Bronnert ..... D01F 11/02 34/493
1,531,343 A * 3/1925 Naito ..... D01B 7/04 242/157 R (Continued)

FOREIGN PATENT DOCUMENTS

CN 103451882 A 12/2013
CN 106988050 A 7/2017

(Continued)

*Primary Examiner* — Stephen M Gravini
(74) *Attorney, Agent, or Firm* — SZDC Law PC

(57) ABSTRACT

The invention provides a drying apparatus and a method for a raw silk degumming process. The drying apparatus includes a drying oven in which a silk strand cover and an air supply unit are disposed. An upper opening and a lower opening are respectively provided at the top and the bottom of the silk strand cover. A silk strand to be dried passes through the silk strand cover. A convex portion is disposed on a sidewall of the silk strand cover, which is protruded toward an outer side of the silk strand cover. The air supply unit is used for providing an air supply flow into the silk strand cover to dry the silk strand. A falling point of the air supply flow is located at the convex portion of the silk strand cover. By means of the apparatus, silkworm silk can be endowed with special elasticity and fluffiness performances.

9 Claims, 1 Drawing Sheet

(58) Field of Classification Search
USPC ..... 34/459
See application file for complete search history.

(56) References Cited

U.S. PATENT DOCUMENTS

| | | | | | |
|---|---|---|---|---|---|
| 2,308,767 | A * | 1/1943 | Mayes | F26B 13/001 | 34/535 |
| 4,468,937 | A | 9/1984 | Bertoldi | | |
| 4,471,537 | A * | 9/1984 | Meda | F26B 23/005 | 34/225 |
| 5,926,970 | A * | 7/1999 | Zonco | D06B 3/16 | 28/165 |
| 10,876,251 | B2 * | 12/2020 | Van Rooij | D06M 15/17 | |
| 2017/0125179 | A1 * | 5/2017 | Han | C25D 3/562 | |
| 2021/0138071 | A1 * | 5/2021 | Santos | C07K 16/22 | |
| 2021/0388530 | A1 * | 12/2021 | Sun | D01B 7/00 | |

FOREIGN PATENT DOCUMENTS

| | | | | | |
|---|---|---|---|---|---|
| CN | 107558068 | A | 1/2018 | | |
| CN | 110552073 | A * | 12/2019 | D01C 3/02 | |
| CN | 110552073 | A | 12/2019 | | |
| CN | 210826453 | U | 6/2020 | | |
| JP | 6446430 | B2 * | 12/2018 | A41G 3/0083 | |
| WO | WO-2014147459 | A1 * | 9/2014 | A41G 3/0083 | |
| WO | WO-2021068717 | A1 * | 4/2021 | D01C 3/02 | |

* cited by examiner

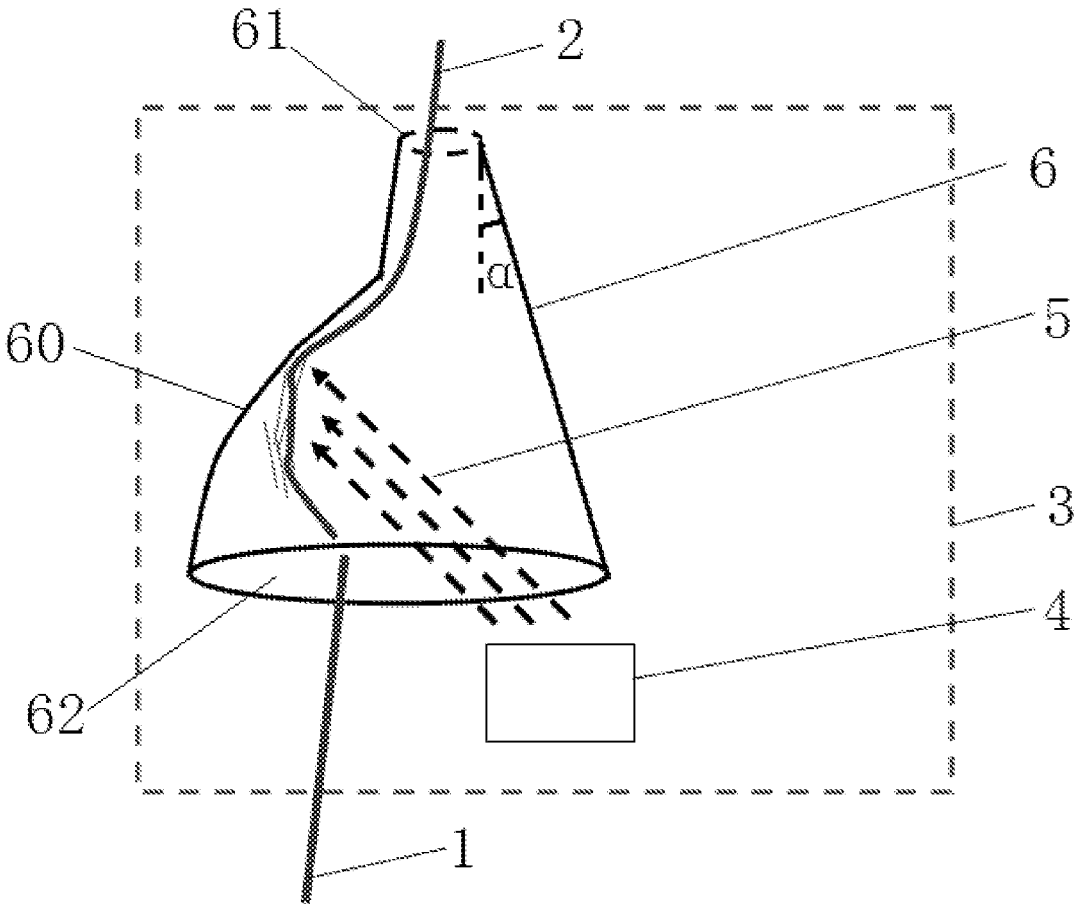
61
2
6
α
60
5
3
4
62
1

DRYING APPARATUS AND DRYING METHOD FOR RAW SILK DEGUMMING PROCESS

This application is the National Stage Application of PCT/CN2020/115597, filed on Sep. 16, 2020, which claims priority to Chinese Patent Application No. 201910950058.5, filed on Oct. 8, 2019, which is incorporated by reference for all purposes as if fully set forth herein.

FIELD OF THE INVENTION

The present invention relates to the field of textile science and technology, and more particularly to a drying apparatus and a drying method for a raw silk degumming process.

DESCRIPTION OF THE RELATED ART

Silk is a fiber formed by liquid silk within a silkworm after spinning and hardening and is referred to as cocoon silk. Raw silk is a product obtained after silk is reeled from mulberry silkworm cocoons, is commonly referred to as filature silk, and consists of approximately 70% to 80% of fibroin and approximately 20% to 30% of sericin.

In raw silk, sericin irregularly covers the surface of fibroin in the form of scales and serves to protect the fibroin. However, excessive sericin affects the luster, texture, and the like of silkworm silk and also affects subsequent treatment of silk products of wild silkworms. Therefore, sericin in silkworm silk needs to be removed. A process of removing sericin is referred to as degumming. After partial sericin substance is removed from raw silk, the silk is soft with luster, and is referred to as "soft silk."

A process of degumming raw silk mainly includes: pretreatment, primary degumming, refining, washing, and drying. At present, a main objective of degumming raw silk is to remove sericin according to a pre-set degumming ratio and at the same time to remove impurities such as fats and waxes in silkworm silk to make the silkworm silk soft and clean.

At present, one improvement made to a raw silk degumming technology is focusing on a degumming process to improve product quality. For example, raw silk degumming methods are disclosed in Chinese Patent Publication No. CN107190333A and Chinese Patent Application No. 201010192430.X. Another improvement is to use a new method to degum raw silk. For example, a high-pressure refining process and an ultrasonic degumming method for silkworm silk threads/yarns are disclosed in Chinese Patent Application No. 201610605911.6 and Chinese Patent Application No. 201610199876.2.

In a raw silk degumming process, a conventional drying process has a simple, clear objective, that is, to dissipate water that enters silkworm silk in a silkworm silk degumming process. In technologies disclosed at present, there is no report on the use of a dedicated apparatus and method in a raw silk degumming process to increase the elasticity and fluffiness of the silkworm silk.

Silkworm silk products are popular among consumers thanks to the great wearability and special appearance. However, silk products are also limited by historical inheritance and lack innovations and therefore vitality. For example, if silkworm silk is endowed with new performance features through special approaches in a drying phase in a raw silk degumming process, silkworm silk products can have better versatility and variety.

SUMMARY OF THE INVENTION

To solve the foregoing technical problem, an object of the present invention is to provide a drying apparatus and a drying method for a raw silk degumming process. The apparatus in the present invention has reasonable structure. By means of the apparatus, silkworm silk can be endowed with special elasticity performance and fluffiness performance in a drying phase for degumming raw silk.

A first object of the present invention is to provide a drying apparatus in a raw silk degumming process, the drying apparatus includes a drying oven, where a silk strand cover and an air supply unit are disposed in the drying oven, an upper opening and a lower opening are provided at the top and the bottom of the silk strand cover respectively, and a silk strand to be dried pass through the silk strand cover, a convex portion is disposed on a part of a sidewall of the silk strand cover, the convex portion is protruded towards an outer side of the silk strand cover, the air supply unit is used for providing an air supply flow into the silk strand cover to dry the silk strand, and a falling point of the air supply flow is located at the convex portion of the silk strand cover.

Preferably, a size of the upper opening is less than that of the lower opening.

Preferably, the air supply unit is located below the lower opening. More preferably, the air supply unit is located laterally below the lower opening. An angle between the direction of an air flow generated by the air supply unit and the horizontal plane is less than an angle between the sidewall of the silk strand cover and the horizontal plane.

Preferably, the air supply unit is an air blower.

Preferably, one end of the convex portion is located at a middle-upper portion of the sidewall, and the other end is located at the bottom side of the sidewall. More preferably, a ratio of the height of the convex portion to that of the silk strand cover is 1:1-4.

Preferably, the shape of the convex portion may be selected as required. Preferably, the convex portion has an arc-shaped spherical surface. In this way, an arc-shaped convex is provided on a part of the sidewall of the silk strand cover, and another part of the sidewall extends along a straight line.

Preferably, an inner diameter ratio of the upper opening to the lower opening is 1:10-50. Preferably, the inner diameter ratio of the upper opening to the lower opening is 1:10 to 1:20.

Preferably, an angle between the sidewall of the silk strand cover and the vertical direction is 5° to 25°, and more preferably is 10°.

Preferably, a winding mechanism is disposed at an outlet end of the drying oven, and the winding mechanism is used for winding a dried silk strand to form a winding.

Preferably, the winding mechanism is located above the upper opening.

Preferably, the upper opening of the silk strand cover is provided near the outlet end of the drying oven, and the lower opening of the silk strand cover is provided near an inlet end of the drying oven.

Preferably, in the present invention, the shape of the silk strand cover may be selected as required. Preferably, the silk strand cover is substantially tapered, and the upper opening and the lower opening of the silk strand cover are both circular.

In the present invention, "a falling point of the air supply flow" refers to an intersection of the air supply flow and the silk strand cover.

A second object of the present invention is to provide a drying method for a raw silk degumming process, which uses the foregoing drying apparatus of the present invention, and includes the following steps:

sequentially passing a silk strand to be dried from bottom to top through a lower opening and an upper opening of a silk strand cover, and at the same time providing an air supply flow into the silk strand cover by using an air supply unit to dry the silk strand, where a falling point of the air supply flow is located on the silk strand to be dried at the convex portion of the silk strand cover.

Preferably, a movement speed of the silk strand to be dried relative to a drying oven is 0.1 m/s to 1 m/s, and a specific speed depends on the temperature in the drying oven and the thickness of the silk strand.

Preferably, a difference between the temperature of the air supply flow and the temperature in the drying oven is within 20° C. More preferably, the temperature of the air supply flow is within a range from the set temperature of the drying oven to a sum of the set temperature and 20° C.

Preferably, the silk strand to be dried is a raw silk strand washed after degumming. The linear density of the silk strand may be 20/22D, 40/44D, 60/66D, or the like.

Preferably, a winding mechanism is disposed at an outlet end of the drying oven, and a dried silk strand comes out from the outlet end to be wound by the winding mechanism to form a winding.

Preferably, the temperature in the drying oven is 70 to 130 degrees, and more preferably is 100° C.

The drying method for a raw silk degumming process in the present invention uses a drying apparatus with a special structure. Because the drying apparatus is provided with a convex portion, when the air supply flow generated by the air supply unit is supplied to the surface of the silk strand to be dried, the silk strand to be dried bends toward a protrusion direction of the convex portion, and the falling point of the air supply flow is located at the convex portion of the silk strand cover, so that:

(1) When the silk strand to be dried is blown to the convex portion under the action of the air supply flow, fiber spacings in the silk strand are increased, and the twist status of fibers is enhanced, thereby improving the elasticity and fluffiness of silkworm silk.

(2) The dried silk strand is not blown by the air supply flow, so that a subsequent treatment process of the silk strand is not influenced by the airflow.

The linear density of a mulberry silkworm silk filament is usually between 2.5D and 3.5D. Raw silk is a porous fiber formed by combining a plurality of silkworm silk filaments in a silk reeling process, and there are spacings between fibers. Raw silk has a triangular cross section, an irregular conical spiral arrangement, and a slight twist status. This characteristic of raw silk is used in the present invention. A special apparatus is used in the last step of degumming, that is, a drying step. Under the action of the air flow, a silk strand is blown by hot air to increase spacings in silkworm silk and enhances the twist status of the silkworm silk, so that the silkworm silk is endowed with particular elasticity and fluffiness.

By means of the foregoing technical solution, the present invention has the following advantages:

The present invention provides a drying apparatus and a drying method for a raw silk degumming process based on the drying apparatus. By means of the apparatus and method, during the drying of degummed silkworm silk, water in the silkworm silk can be dissipated and elasticity and fluffiness can be improved as required.

The foregoing description is merely brief description of the technical solution of the present invention. In order to understand the technical means of the present invention more clearly and implement the invention according to the content of the specification, the preferred embodiments of the present invention are described below in detail with reference to the accompanying drawings.

BRIEF DESCRIPTION OF THE DRAWINGS

FIG. 1 is a schematic sectional view of a drying apparatus for a raw silk degumming process according to the present invention.

REFERENCE NUMERALS

1—silk strand before drying; 2—dried silk strand; 3—drying oven; 4—air supply unit; 5—air supply flow; 6—silk strand cover; 60—convex portion; 61—upper opening; and 62—lower opening.

DETAILED DESCRIPTION OF THE PREFERRED EMBODIMENTS

The present invention is further illustrated below in detail with reference to the accompanying drawings and embodiments. The following embodiments are used to describe the present invention, but are not intended to limit the scope of the present invention.

Embodiment 1

Referring to FIG. 1, a drying apparatus for a raw silk degumming process according to a preferred embodiment of the present invention includes a drying oven 3. A hot environment is provided in the drying oven 3. The temperature of the hot environment may be set as required. The drying oven 3 includes an inlet end at a lower portion thereof and an outlet end at the top thereof. A silk strand 1 to be dried enters the drying oven 3 through the inlet end, and the elasticity and fluffiness are increased while the silk strand 1 is dried in the drying oven 3. The dried silk strand 2 comes out from the outlet end. A winding mechanism is disposed at the outlet end of the drying oven 3. The dried silk strand 2 is wound by the winding mechanism into a required winding.

A silk strand cover 6 and an air supply unit 4 are disposed in the drying oven 3. A silk strand to be dried passes through the silk stand cover. The silk strand cover 6 is substantially tapered and has a height of 30 cm. An angle $\alpha$ between a tapered sidewall and the vertical direction is 10 degrees. An upper opening 61 and a lower opening 62 are opened at the top and the bottom of the silk strand cover 6 respectively. The upper opening 61 and the lower opening 62 are both circular. The upper opening 61 is disposed near the outlet end of the drying oven 3, and the lower opening 62 is disposed near the inlet end of the drying oven 3. The diameter of the upper opening 61 is 1 cm, and the diameter of the lower opening 62 is 16 cm. A convex portion 60 is disposed on a part of the sidewall of the silk strand cover 6. The convex portion 60 is protruded toward an outer side of the silk strand cover 6. The convex portion 60 has an arc-shaped spherical surface. One end of the convex portion 60 is located at a middle-upper portion of the sidewall, and the other end is located at a bottom side of the sidewall. The height of the convex portion 60 is 20 cm. In a sectional view at an angle, the silk strand cover 6 is asymmetrical due to the convex portion 60. As shown in FIG. 1, the silk strand cover 6 has a left sidewall and a right sidewall. The left sidewall is consisted of an upper left wall (10 cm high) and a lower left wall (20 cm high). The upper left wall and the right sidewall are symmetrical, and an angle between the upper left wall and the vertical direction is also 10 degrees. The lower left wall is arc-shaped, that is, a cross section of the convex portion 60.

The air supply unit 4 is located laterally below the lower opening 62. The air supply unit 4 supplies air according to a preset direction and air speed. An angle between the direction of an air flow generated by the air supply unit 4 and the horizontal plane is less than an angle between the sidewall of the silk strand cover 6 and the horizontal plane. The air supply unit 4 is used for providing an air supply flow 5 into the silk strand cover 6 to dry the silk strand. A falling point of the air supply flow 5 is located at the convex portion 60 of the silk strand cover 6. The air supply unit 4 is preferably an air blower.

Embodiment 2

This embodiment provides a drying method for a raw silk degumming process, using the drying apparatus in Embodiment 1. The method includes the following steps.

1) A washed and degummed raw silk strand continuously and uniformly passes through the drying oven 3 at a particular pulling speed (the speed is 0.2 m/s). The linear density of the silk strand may be 20/22D, 40/44D, 60/66D, or the like. The temperature in the drying oven 3 is 100° C. After entering the drying oven 3, the washed and degummed raw silk strand enters the silk strand cover 6 through the lower opening 62 and exits the silk strand cover 6 through the upper opening 61. In this process, the air supply unit 4 supplies air laterally from below the lower opening 62 to generate the air supply flow 5. Air flows from bottom to top, and forms a particular angle from the horizontal plane. The angle may be optionally 30 degrees. A falling point of the air supply flow 5 on the silk strand cover 6 is controlled to be located on the convex portion 60. The temperature of the air supply flow 5 is 100° C. Under the action of the air supply flow 5, the washed and degummed raw silk strand bends toward the protrusion direction of the convex portion 60, so that fiber spacings in the silk strand are increased, and the twist status of fibers is enhanced, thereby improving the elasticity and fluffiness of silkworm silk. In addition, the part of the silk strand which is not located at the convex portion 60 is not blown by the air supply flow 5, thus the further treatment of the dried silk strand 2 will not be influenced.

2) The dried silk strand 2 comes out from the upper opening 61 and is wound by a winding mechanism to form a winding.

A degummed raw silk strand is dried by using the foregoing method, so that water in silkworm silk can be dissipated, the elasticity and fluffiness of the silkworm silk are increased. The crimp contraction and crimp stability of the silkworm silk dried by using the method in the present invention are respectively greater than those of the degummed raw silk dried by using the conventional method. The silkworm silk dried by using the method in the present invention has relatively high elastic resilience and fluffiness, and the texture is relatively soft.

The foregoing descriptions are only preferred embodiments of the present invention, but are not intended to limit the present invention. It should be noted that for a person of ordinary skill in the art, improvements and variations may further be made without departing from the technical principle of the present invention. These improvements and variations should also be deemed as falling within the protection scope of the present invention.

What is claimed is:

1. A drying apparatus for a raw silk degumming process, comprising a drying oven, wherein a silk strand cover and an air supply unit are disposed in the drying oven, an upper opening and a lower opening are provided at a top and a bottom of the silk strand cover respectively, and a silk strand to be dried passes through the silk strand cover, a convex portion is disposed on a sidewall of the silk strand cover, the convex portion is protruded toward an outer side of the silk strand cover, the air supply unit is used for providing an air supply flow into the silk strand cover to dry the silk strand, and a falling point of the air supply flow is located at the convex portion of the silk strand cover, wherein the upper opening and the lower opening are both circular, and a size of the upper opening is less than that of the lower opening.

2. The drying apparatus according to claim 1, wherein the air supply unit is located below the lower opening.

3. The drying apparatus according to claim 1, wherein one end of the convex portion is located at a middle-upper portion of the sidewall, and an other end is located at a bottom side of the sidewall.

4. The drying apparatus according to claim 1, wherein the convex portion has an arc-shaped spherical surface.

5. The drying apparatus according to claim 4, wherein an inner diameter ratio of the upper opening to the lower opening is 1:10-50.

6. The drying apparatus according to claim 1, wherein an angle between the sidewall of the silk strand cover and a vertical direction is 5° to 25°.

7. A drying method for a raw silk degumming process, wherein the drying method uses the drying apparatus according to claim 1, and comprises steps of:

sequentially passing a silk strand to be dried through a lower opening and an upper opening of the silk strand cover, and at a same time providing an air supply flow into the silk strand cover by using an air supply unit to dry the silk strand, wherein a falling point of the air supply flow is located on the silk strand to be dried at the convex portion of the silk strand cover.

8. The drying method according to claim 7, wherein a movement speed of the silk strand to be dried relative to a drying oven is 0.1 m/s to 1 m/s.

9. The drying method according to claim 7, wherein a difference between the temperature of the air supply flow and the temperature in the drying oven is within 20° C.

* * * * *